US007717183B2

(12) United States Patent
Ezell et al.

(10) Patent No.: US 7,717,183 B2
(45) Date of Patent: May 18, 2010

(54) TOP-DOWN HYDROSTATIC ACTUATING MODULE FOR DOWNHOLE TOOLS

(75) Inventors: Michael Dale Ezell, Carrollton, TX (US); Roderick Brand Falconer, Carrollton, TX (US); James Scott, Highland Village, TX (US); Frank Giusti, Jr., Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 259 days.

(21) Appl. No.: 11/408,840

(22) Filed: Apr. 21, 2006

(65) Prior Publication Data

US 2007/0246227 A1 Oct. 25, 2007

(51) Int. Cl.
*E21B 33/10* (2006.01)

(52) U.S. Cl. ..... 166/373; 166/332.1

(58) Field of Classification Search ..... 166/323, 166/319, 332.1, 163, 164, 373
See application file for complete search history.

(56) References Cited

U.S. PATENT DOCUMENTS

| | | | | |
|---|---|---|---|---|
| 5,180,015 | A * | 1/1993 | Ringgenberg et al. | 166/386 |
| 5,411,097 | A * | 5/1995 | Manke et al. | 166/324 |
| 5,662,341 | A | 9/1997 | Ezell et al. | |
| 5,947,201 | A * | 9/1999 | Ross et al. | 166/298 |
| 6,161,622 | A | 12/2000 | Robb et al. | |
| 6,354,374 | B1 * | 3/2002 | Edwards et al. | 166/297 |
| 6,431,276 | B1 | 8/2002 | Robb et al. | |
| 6,648,335 | B1 | 11/2003 | Ezell | |
| 2005/0230122 | A1 * | 10/2005 | Cho et al. | 166/381 |
| 2007/0144731 | A1 * | 6/2007 | Murray et al. | 166/120 |

OTHER PUBLICATIONS

"HHR Hydrostatic-Set Perma-Series(R) Production Packer," Halliburton Brochure, 2 pgs.

"Hydrostatic-Set Perma-Series(R) Production Packers—High-Performance, Single-Trip Permanent Production Packers," Halliburton Brochure, Jul. 2000, 2 pgs.

Patterson, Daniel L. et al., "Interventionless Production Packer Setting Technique Reduces Completion Costs," SPE 69619, SPE Latin American and Caribbean Petroleum Engineering Conference in Buenos Aires, Argentina, Mar. 25-28, 2001, pp. 1-10.

Simonds, Randy, et al., "Remotely Actuated Completion System Offers Cost Efficiency for Offshore Environments," OTC 11930, Offshore Technology Conference in Houston, Texas, May 1-4, 2000, pp. 1-15.

(Continued)

*Primary Examiner*—Shane Bomar
(74) *Attorney, Agent, or Firm*—Rodney Carroll

(57) ABSTRACT

An apparatus for actuating a downhole tool within a well bore comprises a cylindrical mandrel extending longitudinally through the downhole tool; an interventionless, hydrostatic, top-down actuating piston disposed about the mandrel and forming a first chamber and a second chamber therebetween; and a rupture disk that prevents fluid communication between the well bore and the first chamber until sufficient hydrostatic pressure is applied to the well bore to fail the rupture disk.

A method of actuating a downhole tool comprises connecting a top-down actuating module to the downhole tool, running the downhole tool to a desired depth within a well bore, pressuring up the well bore without pressuring up an internal flow bore extending through the top-down actuating module, hydrostatically actuating an upper piston of the top-down actuating module to exert an actuation force onto the downhole tool, and actuating the downhole tool.

21 Claims, 6 Drawing Sheets

OTHER PUBLICATIONS

"Halliburton Interventionless Perma-Series(R) Hydrostatic Set Permanent Production Packers," Halliburton Brochure, Jun. 2002, pp. 1-7.

"Hydrostatic-Set-Packers—Simplify Your Completions Through Intelligent Well Completions Technology," Halliburton Well Completions Flyer, Apr. 2004, 1 pg.

* cited by examiner

TOP-DOWN HYDROSTATIC ACTUATING MODULE FOR DOWNHOLE TOOLS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to interventionless, hydrostatically-actuated, top-down actuating and/or setting modules for downhole tools and methods of actuating and/or setting downhole tools within well bores. More particularly, the present invention relates to interventionless actuating and/or setting modules for downhole tools that provide no potential leak pathway between the production tubing and the well bore annulus, and methods of hydrostatically actuating and/or setting downhole tools without diminishing the hydrostatic actuating force.

BACKGROUND

A variety of downhole tools may be used within a well bore in connection with producing hydrocarbons. A production packer, for example, is one such downhole tool comprising resilient sealing elements and slips that expand outwardly in response to an applied force to engage the inside of a production liner or casing. In this way, the production packer provides a seal between the outside of a tubing upon which the packer is run into the well bore and the inside of a production liner or casing. The production packer performs a number of functions, including but not limited to: isolating one pressure zone of a well bore formation from another, protecting the production liner or casing from reservoir pressure and erosion that may be caused by produced fluids, eliminating or reducing pressure surging or heading, and holding kill fluids in the well bore annulus above the production packer.

Production packers and other types of downhole tools may be run down on production tubing to a desired depth in the well bore before they are set. Conventional production packers are then set hydraulically, requiring that a pressure differential be created across a setting piston. Typically, this is accomplished by running a tubing plug on wireline, slick line, electric line, coiled tubing or another conveyance means through the production tubing down into the downhole tool. Then the fluid pressure within the production tubing is increased, thereby creating a pressure differential between the fluid within the production tubing and the fluid within the well bore annulus. This pressure differential actuates the setting piston to expand the production packer into sealing engagement with the production liner or casing. Before resuming normal operations through the production tubing, the tubing plug must be removed, typically by retrieving the plug back to the surface of the well.

As operators increasingly pursue production completions in deeper water offshore wells, highly deviated wells and extended reach wells, the rig time required to set a tubing plug and thereafter retrieve the plug can negatively impact the economics of the project, as well as add unacceptable complications and risks. To address the issues associated with hydraulically-set downhole tools, an interventionless setting technique was developed. In particular, a hydrostatically-actuated setting module was designed to be incorporated into the bottom end of a downhole tool, and this module exerts an upward setting force on the downhole tool. The hydrostatic setting module may be actuated by applying pressure to the production tubing and the well bore at the surface, with the setting force being generated by a combination of the applied surface pressure and the hydrostatic pressure associated with the fluid column in the well bore. In particular, a piston of the hydrostatic setting module is exposed on one side to a vacuum evacuated initiation chamber that is initially closed off to well bore annulus fluid by a port isolation device, and the piston is exposed on the other side to an enclosed evacuated chamber generated by pulling a vacuum. In operation, once the downhole tool is positioned at the required setting depth, surface pressure is applied to the production tubing and the well bore annulus until the port isolation device actuates, thereby allowing well bore fluid to enter the initiation chamber on the one side of the piston while the chamber engaging the other side of the piston remains at the evacuated pressure. This creates a differential pressure across the piston that causes the piston to move, beginning the setting process. Once the setting process begins, O-rings in the initiation chamber move off seat to open a larger flow area, and the fluid entering the initiation chamber continues actuating the piston to complete the setting process. Therefore, the bottom-up hydrostatic setting module provides an interventionless method for setting downhole tools since the setting force is provided by available hydrostatic pressure and applied surface pressure without plugs or other well intervention devices.

However, the bottom-up hydrostatic setting module may not be ideal for applications where the well bore annulus and production tubing cannot be pressured up simultaneously. Such applications include, for example, when a packer is used to provide liner top isolation or when a packer is landed inside an adjacent packer in a stacked packer completion. The production tubing can not be pressured up in either of these applications because the tubing extends as one continuous conduit out to the pay zone where no pressure, or limited pressure, can be applied.

In such circumstances, if a bottom-up hydrostatic setting module is used to set a packer above another sealing device, such as a liner hanger or another packer, for example, there is only a limited annular area between the unset packer and the set sealing device below. Therefore, when the operator pressures up on the well bore annulus, the hydrostatic pressure begins actuating the bottom-up hydrostatic setting module to exert an upward setting force on the packer. However, when the packer sealing elements start to engage the casing, the limited annular area between the packer and the lower sealing device becomes closed off and can no longer communicate with the upper annular area that is being pressurized from the surface. Thus, the trapped pressure in the limited annular area between the packer and the lower sealing device is soon dissipated and may or may not fully set the packer. Accordingly, a need exists for an interventionless hydrostatic setting apparatus operable to fully set a downhole tool within a well bore in response to surface pressure applied to the well bore annulus only. In an embodiment, this interventionless hydrostatic setting module should provide no potential for fluid leaks between the production tubing and the well bore annulus above the set downhole tool.

With respect to a hydraulically set packer, the operational life of the packer can be adversely affected when the setting force on the piston is dissipated such that the piston no longer exerts a setting force on the packer slips, wedges and resilient sealing elements after the downhole tool is set and the plug is removed from the production tubing. Under such circumstances, as the packer is mechanically and/or thermally loaded during its operational life, the resilient sealing elements expand and contract, but the slips and wedges are not urged to move in response to the loading. This expansion and contraction can cause the resilient sealing elements to become spongy and leak over time. Therefore, a need exists for an interventionless hydrostatic setting apparatus that substantially continually exerts a setting force to fully set the packer or other downhole tool throughout the operational life of the packer without diminishing the actuating force.

SUMMARY OF THE INVENTION

The present disclosure is directed to an interventionless, hydrostatic, top-down actuating apparatus for a downhole tool within a well bore. In an embodiment, a downhole tool comprises the actuating apparatus. In an embodiment, the actuating apparatus comprises no fluid communication pathway between a fluid flow bore extending through the actuating apparatus and the well bore surrounding the actuating apparatus. The present disclosure is also directed to an apparatus for actuating a downhole tool within a well bore comprising a mandrel having a solid wall surrounding a fluid flow bore extending longitudinally therethrough, the solid wall preventing fluid communication between the fluid flow bore and the well bore.

In another aspect, the present disclosure is directed to an apparatus for actuating a downhole tool within a well bore comprising an interventionless, hydrostatic, top-down actuating module connected above the downhole tool and having a fluid flow bore extending longitudinally therethrough surrounded by a wall that presents no potential fluid leak path between the fluid flow bore and the well bore above the downhole tool. The apparatus may further comprise a hydraulic, bottom-up contingency actuating module connected below the downhole tool and having a throughbore extending longitudinally therethrough in fluid communication with the fluid flow bore. In an embodiment, a solid wall surrounds the throughbore in the bottom-up contingency actuating module, thereby presenting no potential leak path between the throughbore and the well bore below the downhole tool, and a port is selectively generated through the solid wall to actuate the bottom-up contingency actuating module.

The present disclosure is further directed to an apparatus for actuating a downhole tool within a well bore comprising a cylindrical mandrel extending longitudinally through the downhole tool; an interventionless, hydrostatic, top-down actuating piston disposed about the mandrel and forming a first chamber and a second chamber therebetween; and a rupture disk that prevents fluid communication between the well bore and the first chamber until sufficient hydrostatic pressure is applied to the well bore to fail the rupture disk. The apparatus may further comprise an upper locking mechanism for locking the downhole tool in an actuated position after the top-down actuating piston is hydrostatically actuated to actuate the downhole tool into the actuated position. In an embodiment, the apparatus further comprises an anti-rotation clutch forming a connection between the top-down actuating piston and the upper locking mechanism when the top-down actuating piston is hydrostatically actuated to actuate the downhole tool. The apparatus may further comprise a hydraulic, bottom-up contingency actuating piston disposed about the mandrel. In an embodiment, the mandrel comprises an internal profile to receive a plug for hydraulically-actuating the bottom-up contingency actuating piston. The apparatus may further comprise a port generated through a wall of the mandrel to hydraulically-actuate the bottom-up contingency actuating piston. In an embodiment, the apparatus further comprises a lower locking mechanism for locking the downhole tool in an actuated position after the bottom-up contingency actuating piston is hydraulically actuated to actuate the downhole tool into the actuated position.

In yet another aspect, the present disclosure is directed to a packer comprising a cylindrical mandrel with a fluid flow bore extending longitudinally therethrough; an interventionless, hydrostatic, top-down setting apparatus disposed about the mandrel; and a plurality of packer sealing elements disposed about the mandrel below the top-down setting apparatus; wherein the packer provides no fluid communication pathway between the fluid flow bore and a well bore surrounding the packer above the packer sealing elements.

In still another aspect, the present disclosure is directed to a method of actuating a downhole tool to seal against a wall of a well bore comprising running the downhole tool to a desired depth within the well bore above a seal within the well bore, exerting a hydrostatic actuating force to actuate the downhole tool, and setting the downhole tool to seal against the wall of the well bore without diminishing the hydrostatic actuating force.

In an embodiment, a method of actuating a downhole tool within a well bore comprises connecting a top-down actuating module to the downhole tool, running the downhole tool to a desired depth within the well bore, pressuring up the well bore without pressuring up an internal flow bore extending through the top-down actuating module, hydrostatically actuating an upper piston of the top-down actuating module to exert an actuation force onto the downhole tool, and actuating the downhole tool into an actuated position. The method may further comprise maintaining the actuation force on the downhole tool after actuating the downhole tool. Hydrostatically actuating the upper piston may comprise opening a pathway into a first chamber of the top-down actuating module, filling the first chamber with a fluid from the well bore, exerting an actuating force on the piston due to the pressure differential between the first chamber and a second chamber. In an embodiment, opening the pathway comprises failing a rupture disk. The method may further comprise locking the downhole tool in the actuated position. The method may also comprise preventing the upper piston from rotating upon actuating the downhole tool. In an embodiment, the method further comprises connecting a hydraulic, bottom-up contingency actuating module to the downhole tool before running the downhole tool to the desired depth within the well bore. If the upper piston fails to exert an actuation force onto the downhole tool, the method may further comprise inserting a plug into a throughbore of the bottom-up contingency actuating module, pressuring up the throughbore, hydraulically actuating a lower piston of the bottom-up contingency actuating module to exert an actuation force onto the downhole tool, and actuating the downhole tool into an actuated position. In an embodiment, the method further comprises generating a port through a wall surrounding the throughbore to hydraulically actuate the lower piston. In various embodiments, the method further comprises landing the downhole tool within a tie-back component of a liner hanger at the desired depth within the well bore, or landing the downhole tool into another downhole tool at the desired depth within the well bore.

NOTATION AND NOMENCLATURE

Certain terms are used throughout the following description and claims to refer to particular structural components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", "upwardly" or "upstream" meaning toward the surface of the well and with "down", "lower", "downwardly" or "downstream" meaning toward the bottom end of the well, regardless of the well bore orientation.

As used herein, the terms "bottom-up" and "top-down" will be used as adjectives to identify the direction of a force that actuates a downhole tool, with "bottom-up" generally referring to a force that is exerted from the bottom of the tool upwardly toward the surface of the well, and with "top-down" generally referring to a force that is exerted from the top of the tool downwardly toward the bottom end of the well, regardless of the well bore orientation.

As used herein, the terms "hydraulic" and "hydraulically-actuated" will be used to identify conventional actuating or setting modules that are actuated by plugging a fluid flow bore therein and then applying pressure above the plug.

As used herein, the terms "hydrostatic" and "hydrostatically-actuated" will be used to identify actuating or setting modules that are actuated by applying pressure to the well bore without plugging a fluid flow bore therein, as distinguished from "hydraulic" and "hydraulically-actuated" conventional actuating modules.

As used herein, the term "rupture disk" will be used broadly to identify any type of actuatable device operable to selectively open a port, including but not limited to a rupture disk, a shifting sleeve, and a shear plug device, for example.

DETAILED DESCRIPTION

The present disclosure relates to interventionless actuating modules for downhole tools. In this context, the term "interventionless" is well understood by those of ordinary skill in the art. In an embodiment, the interventionless actuating module is operable to actuate a downhole tool without running another component into the well bore to contact or otherwise interact with the actuating module. In an embodiment, the interventionless actuating module is operable to actuate a downhole tool without making a separate trip into the well bore to initiate the actuation. In this regard, the interventionless actuating module does not require intervention means such as a tubing plug run into the well on a wireline, coiled tubing, electric line, slick line, or another conveyance means.

Figure 1:
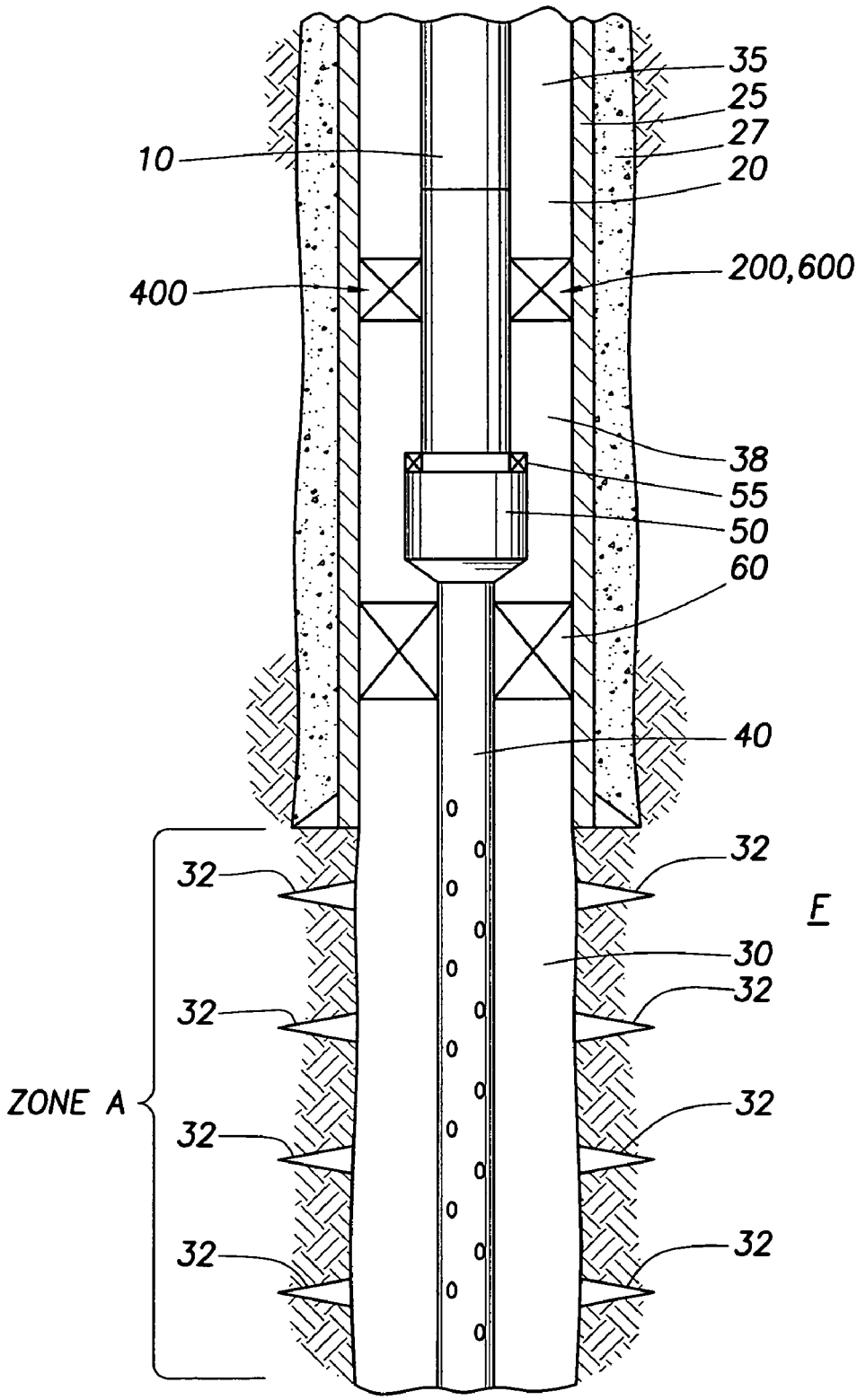
FIG. 1 provides a schematic side view, partially in cross-section, of a representative operating environment for a packer system employed within a well bore as a liner top isolation packer.

FIG. 1 schematically depicts one representative operating environment for a packer system 200, 600 that will be more fully described herein. In FIG. 1, the packer system 200, 600 is employed to provide liner top isolation in a production environment. A well bore 20 is shown penetrating a subterranean formation F for the purpose of recovering hydrocarbons. At least the upper portion of the well bore 20 may be lined with casing 25 that is cemented 27 into position against the formation F in a conventional manner. A liner hanger 60 sealingly engages the casing 25 to suspend a perforated production liner 40 within a lower well bore portion 30 adjacent a producing pay zone A of the formation F with perforations 32 extending therein. A tie-back connector or polished bore receptacle (PBR) 50 is disposed above the liner hanger 60 at the upper end of the perforated production liner 40 to receive the packer system 200, 600. In particular, once the liner hanger 60 has been deployed to suspend the perforated production liner 40, the packer system 200, 600 may be run into the well bore 20 on production tubing 10 using regular completion techniques and landed within the PBR 50, which seals 55 against the lower end of the packer system 200, 600. Then a packer assembly 400 of the packer system 200, 600 is set into sealing engagement with the casing 25, as will be more fully described herein. In the liner top isolation configuration shown in FIG. 1, the packer system 200, 600 provides a back-up seal to the liner hanger 60 to ensure isolation of the upper well bore portion 35 from the lower well bore portion 30, which is exposed to reservoir pressure from the producing pay zone A.

When the packer system 200, 600 is employed for liner top isolation as shown in FIG. 1, the packer assembly 400 may be set by conventional hydraulic methods using a tubing plug, or the packer assembly 400 may be set interventionlessly by applying hydrostatic pressure to the well bore 20 at the surface. However, because the production tubing 10 is in direct fluid communication with the perforated production liner 40 that extends into the lower well bore portion 30 where produced fluids flow in from the producing pay zone A through the perforations 32, only limited hydrostatic pressure can be applied to the production tubing 10 at the surface. In particular, pressuring up the production tubing 10 would also pressure up the production liner 40 as well as the lower well bore portion 30 adjacent the pay zone A, and such pressure may cause irreparable damage to the formation F.

While the representative operating environment depicted in FIG. 1 refers to a packer system 200, 600 operable for liner top isolation, one of ordinary skill in the art will readily appreciate that the packer system 200, 600 may also be employed in other applications where hydrostatic pressure may be applied only to the well bore 20, but not the production tubing 10 at the surface. For example, the packer system 200, 600 may be employed within a stacked packer completion. It should also be understood that the packer system 200, 600 may be employed in applications where hydrostatic pressure can be applied to both the production tubing 10 and the well bore 20. Further, the packer system 200, 600 may be used in any type of well bore 20, whether on land or at sea, including deep water well bores; vertical well bores; extended reach well bores; high pressure, high temperature (HPHT) well bores; and highly deviated well bores.

The packer system 200, 600 may take a variety of different forms. FIGS. 2A through 2D, when viewed sequentially from end to end, depict one embodiment of a packer system 200 comprising an interventionless, hydrostatically-actuated, top-down setting module 300; a packer assembly 400; and a hydraulically-actuated, bottom-up contingency setting module 500; all supported by a packer mandrel 210 extending internally therethrough. The packer mandrel 210 comprises an elongated tubular body member with a solid wall 220 surrounding a fluid flow bore 205 that extends longitudinally through the length of the packer mandrel 210. The packer mandrel 210 may comprise an upper threaded box-end 215, for example, to form a threaded connection to the production tubing 10 as shown in FIG. 1, and a lower threaded pin-end 225, for example, to form a threaded connection 216 to a bottom sub 510 as shown in FIG. 2D. The bottom sub 510 may comprise an upper box end that forms a hydraulic cylinder 511 as shown in FIG. 2C and a lower pin end 515 as shown in FIG. 2D for landing the packer system 200 into the PBR 50 as shown in FIG. 1.

Figure 2A:
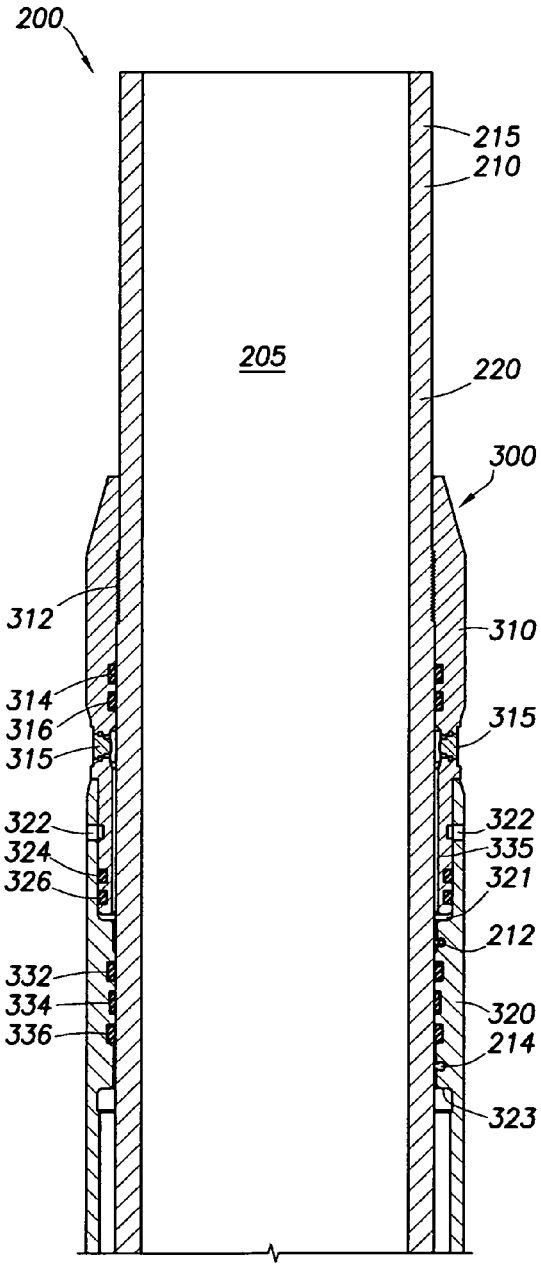
FIGS. 2A through 2D, when viewed sequentially from end-to-end, provide a cross-sectional side view of one embodiment of a packer system comprising an interventionless, hydrostatically-actuated, top-down actuating or setting module connected to a packer assembly, which in turn is connected to a hydraulically actuated, bottom-up contingency setting module.
Figure 2B:
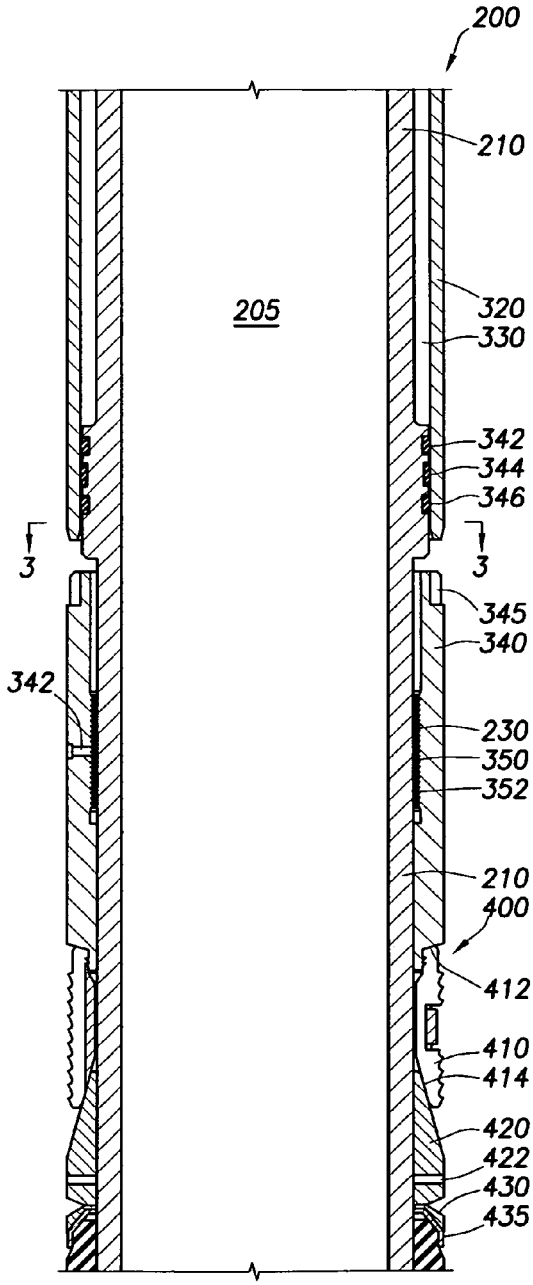
Figure 2C:
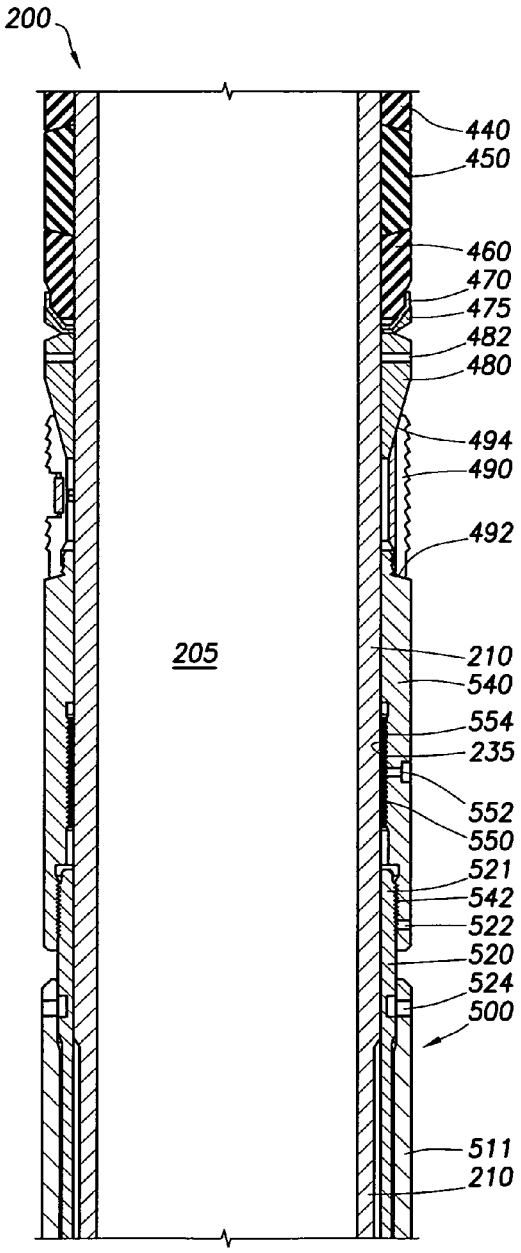
Figure 2D:
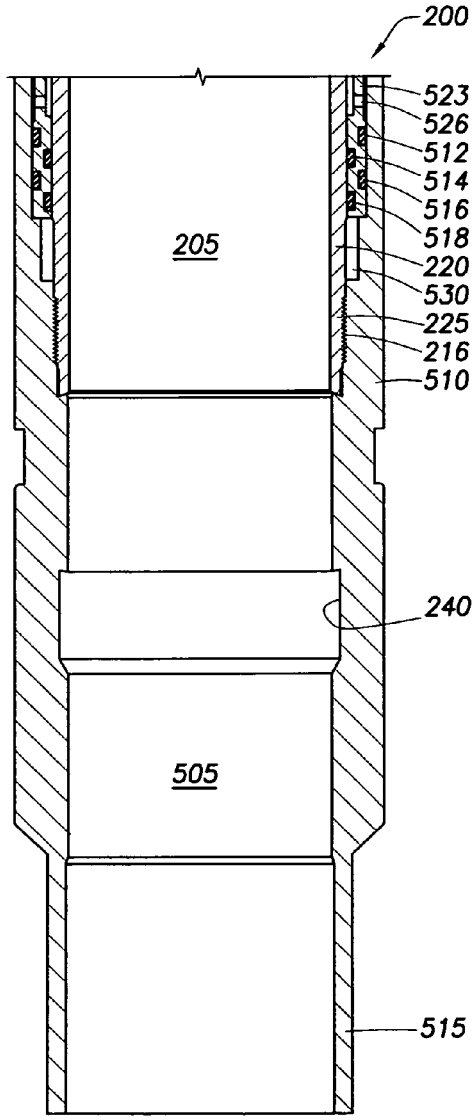

Referring now to FIGS. 2A and 2B, the interventionless, hydrostatically-actuated, top-down setting module 300 is disposed externally of the packer mandrel 210 above the packer assembly 400 and comprises a top sub 310, a hydrostatic piston 320, an initiation chamber 335, an atmospheric chamber 330, an upper lock ring housing 340, and an upper lock ring 350. The top sub 310 is connected via threads 312 to the packer mandrel 210 and via anti-preset screws 322 to the hydrostatic piston 320. The initiation chamber 335 comprises a small gap formed between the packer mandrel 210 and the top sub 310. The initiation chamber 335 is initially evacuated by pulling a vacuum and the vacuum in the initiation chamber 335 acts against an upper surface 321 of the hydrostatic piston 320. A rupture disk 315 disposed in the top sub 310 initially blocks fluid entry into the initiation chamber 335 from the well bore 20. O-ring seals 314, 316 are provided between the top sub 310 and the packer mandrel 210 and O-ring seals 324, 326 are provided between the top sub 310 and the hydrostatic piston 320 to seal off the initiation chamber 335.

The atmospheric chamber 330 comprises an elongate cavity formed between the packer mandrel 210 and the hydrostatic piston 320, and the atmospheric chamber 330 is initially evacuated by pulling a vacuum. The vacuum in the atmospheric chamber 330 acts against an actuating surface 323 of the hydrostatic piston 320. Upper O-ring seals 332, 336 and lower O-ring seals 342, 346 are provided between the packer mandrel 210 and the hydrostatic piston 320 to seal off the atmospheric chamber 330. Upper and lower centralizer rings 334, 344 are operable to properly position the hydrostatic piston 320 about the packer mandrel 210 and form a uniformly shaped atmospheric chamber 330. Monitor spools with metal-to-metal seats 212, 214 are provided between the hydrostatic piston 320 and the packer mandrel 210 for reliability testing of the O-ring seals 314, 316, 324, 326 surrounding the initiation chamber 335 and the O-ring seals 332, 336, 342, 346 surrounding the atmospheric chamber 330 at the surface. In various embodiments, the O-rings 314, 316, 324, 326, 332, 336, 342, 346 comprise AFLAS® O-rings with PEEK back-ups for severe downhole environments, Viton O-rings for low temperature service, Nitrile or Hydrogenated Nitrile O-rings for high pressure and temperature service, or a combination thereof. In an embodiment, the packer system 200 is rated for an operating temperature range of 40 to 450 degrees Fahrenheit.

Positioned below the hydrostatic piston 320 is an upper lock ring housing 340 that secures an upper lock ring 350 to the packer mandrel 210. Set screws 342 are employed to keep the upper lock ring 350 from rotating within the upper lock ring housing 340. The upper lock ring 350 comprises a plurality of downwardly angled teeth 352 that engage and interact with a corresponding saw-tooth profile 230 on the packer mandrel 210. Such a saw-tooth profile 230 is also commonly referred to as a "phonograph finish" or a "wicker". Due to the interaction of the downwardly angled teeth 352 and the saw-tooth profile 230 on the packer mandrel 210, the upper lock ring housing 340 and the upper lock ring 350 are designed to move downwardly but not upwardly with respect to the packer mandrel 210, and these components 340, 350 lock the packer assembly 400 in a set position when the hydrostatic piston 320 actuates, as will be more fully described herein.

Referring now to FIGS. 2B and 2C, the packer assembly 400 is positioned externally of the packer mandrel 210 between the top-down setting module 300 and the bottom-up contingency setting module 500. The packer assembly 400 comprises an upper slip 410, an upper wedge 420, an upper element support shoe 430, an upper element backup shoe 435, one or more resilient sealing elements 440, 450, 460, a lower element support shoe 470, a lower element backup shoe 475, a lower wedge 480 and a lower slip 490. The upper slip 410 forms a sliding engagement 412 with the upper lock ring housing 340 and forms a sliding engagement 414 with the upper wedge 420, which is initially connected via shear pins 422 to the packer mandrel 210. Similarly, the lower slip 490 forms a sliding engagement 492 with a lower lock ring housing 540 and forms a sliding engagement 494 with the lower wedge 480, which is initially connected via shear pins 482 to the packer mandrel 210. In an embodiment, the upper and lower slips 410, 490 comprise C-ring slips manufactured from low yield AISI grade carbon steel to allow for easier milling. In an embodiment, the slips 410, 490 may also be case-carburized with a surface-hardening treatment to provide a hard tooth surface operable to bite into high yield strength casing.

In an embodiment, the packer assembly 400 comprises a three-piece resilient sealing element system with a soft center element 450 formed of 70 durometer nitrile and hard end elements 440, 460 formed of 90 durometer nitrile. In an embodiment, the harder end elements 440, 460 provide an extrusion barrier for the softer center element 450, and the multi-durometer packer elements 440, 450, 460 seal effectively in high and low pressure applications, as well as in situations where casing wear is more evident in the packer setting area. The upper and lower element support shoes 430, 470 and the upper and lower element backup shoes 435, 475 enclose the resilient sealing elements 440, 450, 460 at the upper and lower ends, respectively, and provide anti-extrusion back up to the resilient sealing elements 440, 450, 460. In an embodiment, the upper and lower element support shoes 430, 470 comprise yellow brass and the upper and lower element backup shoes 435, 475 comprise AISI low yield carbon steel.

Referring now to FIGS. 2C and 2D, the hydraulically-actuated, bottom-up contingency setting module 500 is positioned externally of the packer mandrel 210 below the packer assembly 400 and comprises a hydraulic piston 520, a lower lock ring housing 540, and a lower lock ring 550. The hydraulic piston 520 is disposed externally of the packer mandrel 210 and extends between the packer mandrel 210 and the hydraulic cylinder 511 of the bottom sub 510 to which the hydraulic piston 520 initially connects via shear screws 524. An upper end 521 of the hydraulic piston 520 connects via threads 542 and set screws 522 to the lower lock ring housing 540, and a lower end 523 of the hydraulic piston 520 sealingly engages the packer mandrel 210 via O-rings 514, 518 and sealingly engages the bottom sub 510 via O-rings 512, 516. A recess 530 is provided within the bottom sub 510 below the lower end 523 of the hydraulic piston 520. An internal profile 240 within the flow bore 505 of the bottom sub 510 is configured to receive a punch-to-set tool (not shown) operable to punch a hole through the wall 220 of the packer mandrel 210 in the vicinity of the recess 530 in the event the bottom-up contingency setting module 500 will be operated to set the packer assembly 400. The term "punch-to-set tool" may identify any device operable to perforate the packer mandrel 210, including but not limited to chemical, mechanical and pyrotechnic perforating devices. The punch-to-set tool also acts as a tubing plug within the packer mandrel 210 as will be more fully described below. In another embodiment, the packer mandrel 210 includes a pre-punched port through the mandrel wall 220 in the vicinity of the recess 530, but this embodiment provides somewhat less control over the possible inadvertent setting of the hydraulic piston 520.

Positioned above the hydraulic piston 520 is a lower lock ring housing 540 that secures a lower lock ring 550 to the packer mandrel 210. Set screws 552 are employed to keep the lower lock ring 550 from rotating within the lower lock ring housing 540. The lower lock ring 550 comprises a plurality of upwardly angled teeth 554 that engage and interact with a corresponding saw-tooth profile 235 on the packer mandrel 210. Due to the interaction of the upwardly angled teeth 554 on the lower lock ring 550 and the saw-tooth profile 235, also known as a "phonograph finish" or a "wicker", on the packer mandrel 210, the lower lock ring housing 540 and the lower lock ring 550 are designed to move upwardly but not downwardly with respect to the packer mandrel 210. These components 540, 550 act to lock the packer assembly 400 in a set position when the hydraulic piston 520 actuates, as will be more fully described herein.

In operation, the packer system 200 of FIGS. 2A through 2D may be run into a well bore 20 on production tubing 10 to a desired depth, for example, and then the packer assembly 400 may be set against casing 25 or against an open borehole wall. Under most circumstances, the packer assembly 400 will be set interventionlessly using the hydrostatically-actuated, top-down setting module 300. However, should the top-down setting module 300 fail to operate properly, the packer assembly 400 may also be set hydraulically via the hydraulically-actuated, bottom-up contingency setting module 500, which requires intervention from the surface.

In one embodiment, the packer system 200 of FIGS. 2A through 2D may be used as a liner top isolation packer, such as shown in FIG. 1. In particular, once the liner hanger 60 has been deployed to suspend the perforated production liner 40 adjacent the producing pay zone A, the packer system 200 may be run into the well bore 20 on production tubing 10 using regular completion techniques and landed within the PBR 50, which seals 55 against the lower end 515 of the bottom sub 510 that lands therein. Then the packer assembly 400 is set by expanding the resilient sealing elements 440, 450, 460 into engagement with the casing 25, thereby providing a back-up seal to the liner hanger 60 to ensure isolation of the upper well bore portion 35 from the lower well bore portion 30, which is exposed to reservoir pressure from the producing pay zone A.

To set the packer assembly 400 interventionlessly using the hydrostatically-actuated, top-down setting module 300, pressure is applied to the fluid column in the well bore 20 at the surface without applying pressure to the fluid within the production tubing 10. As the hydrostatic pressure within the well bore 20 increases, the rupture disks 315 control initiation of the setting motion of the hydrostatic piston 320. In particular, the rupture disks 315 are designed to rupture or fail to open a flow path into the initiation chamber 335 when the rupture disks 315 are exposed to a specific pressure differential. The specific pressure differential is established when the absolute pressure, namely the ambient hydrostatic pressure at the setting depth associated with the column of fluid in the well bore 20 plus the applied surface pressure, reaches a predetermined value, and the backside of the rupture disk 315 is exposed to a lower pressure within the initiation chamber 335. When the absolute pressure reaches the predetermined value, the rupture disks 315 will rupture to allow fluid from the well bore 20 to flow into the initiation chamber 335. As the fluid from the well bore 20 flows into the initiation chamber 335, this fluid pressure acts on the upper surface 321 of the hydrostatic piston 320 while the actuating surface 323 of the hydrostatic piston 320 is in communication with the atmospheric chamber 330 at a lower pressure. Thus, a pressure differential is created across the hydrostatic piston 320 that exerts a downward force against the hydrostatic piston 320. When the downward force is sufficient to overcome the anti-preset screws 322, the anti-preset screws 322 shear and the piston 520 starts to move downwardly to begin the setting process.

The larger volume atmospheric chamber 330 provides the force necessary to set the packer assembly 400. In particular, as the hydrostatic piston 320 moves downwardly into engagement with the upper lock ring housing 350, the atmospheric chamber 330 allows the hydrostatic piston 320 to exert a sufficient downward force to move the upper lock ring housing 340, the upper slip 410, and the upper lock ring 350. This downward force drives the upper slip 410 up and over the upper wedge 420 to engage the casing 25. Continued movement shears the shear pin 422 in the upper wedge 420 and allows further compression of the resilient sealing elements 440, 450, 460 to form a seal against the casing 25. As the resilient sealing elements 440, 450, 460 compress, the shear pin 482 in the lower wedge 480 shears and the lower wedge 480 is driven under the lower slip 490 to drive it outwardly into engagement with the casing 25. As shown in FIG. 2C, the lower slip 490 is forced outwardly against the casing 25 because it engages the lower lock ring housing 540, which is prevented from moving downwardly by the lower lock ring 550 comprising upwardly facing teeth 554 engaging a corresponding saw-tooth profile 235 on the packer mandrel 210. The interaction between the lower lock ring 550 and the packer mandrel 210 allow movement of the lower lock ring housing 540 only in the upward direction.

When the packer assembly 400 is set, the upper element shoe 430 and the upper element backup shoe 435 as well as the lower element shoe 470 and the lower element backup shoe 475 work together to mechanically maintain the squeeze force on the resilient sealing elements 440, 450, 460 and create an element extrusion barrier when the packer assembly 400 is fully set. In addition, the upper lock ring 350 engages the saw-tooth profile 230 of the packer mandrel 210 to lock the packer assembly 400 in the set position via the upper lock ring housing 340. In particular, as the upper lock ring 350 is forced down, the downwardly facing teeth 352 of the upper lock ring 350 slide up and over the corresponding saw-tooth profile 230 on the packer mandrel 210 during the packer assembly 400 setting process. The interaction between the downwardly facing teeth 352 of the upper lock ring 350 and the saw-tooth profile 230 on the packer prevents any upward movement of the upper lock ring 350 and upper lock ring housing 340. Therefore, the upper lock ring 350 holds the upper lock ring housing 340 in the set position to continue exerting a force on the packer assembly 400 components to squeeze the resilient sealing elements 440, 450, 460 into engagement with the surrounding casing 25.

In addition, due to the configuration of the packer system 200, the actuating force will continue acting on the hydrostatic piston 320 to exert a setting force on the packer assembly throughout its service life due to the hydrostatic actuating pressure within the well bore 20.

Therefore, when the packer assembly 400 is mechanically and/or thermally loaded during its operational life, the resilient sealing elements 440, 450, 460 will not be the only components to expand and contract and thereby become spongy to leak over time. Instead, as the interventionless, hydrostatically-actuated, top-down setting module 300 substantially continually exerts a setting force to fully set the packer assembly 400, the hydrostatic actuating pressure from the well bore 20 exerted on the hydrostatic piston 320 is not diminished. Thus, the hydrostatic piston 320 will continue providing a setting force on the slips 410, 490; the wedges 420, 480; and the resilient sealing elements 440, 450, 460.

Referring again to FIGS. 1 and 2A through 2D, when the packer assembly 400 of the packer system 200 is expanded into sealing engagement with the casing 25, the packer assembly 400 functions to isolate the upper well bore portion 35 from the lower well bore portion 30 that is exposed to reservoir pressure. In an embodiment, the packer system 200 presents no potential fluid communication leak paths between the production tubing 10 and the upper well bore portion 35 due to O-rings or other elastomeric seals. In particular, the packer system 200 of FIGS. 2A through 2D comprises a packer mandrel 210 formed of a solid wall 220 with no ports or flow paths extending therethrough, thereby eliminating concerns about O-rings or other elastomeric seals that may allow leaks. Specifically, since there are no ports through the solid wall 220 of the packer mandrel 210, there are no potential leak pathways between the production tubing 10 and the well bore 20, especially into the upper well bore portion 35 above the packer assembly 400.

In the method described above, setting of the packer assembly 400 was accomplished without surface intervention via hydrostatic pressure. However, surface intervention may be required should the hydrostatically-actuated, top-down setting module 300 fail to actuate as expected, which could possibly occur if the atmospheric chamber 330 fills with fluid from the well bore 20 due to leaky O-ring seals. In that event, referring now to FIGS. 2C and 2D, an optional hydraulically-actuated, bottom-up setting module 500 may be provided within the packer system 200 for setting the packer assembly 400 with intervention from the surface as a contingency. To operate the setting module 500, a punch-to-set tool (not shown) is run down into the well bore 20 on wireline, coiled tubing, or another intervention means through the packer mandrel flow bore 205 into the bottom sub flow bore 505 and into sealing engagement with the internal profile 240. Then the punch-to-set tool punches a hole through the wall 220 of the packer mandrel 210 in the vicinity of the recess 530 below the hydraulically-actuated piston 520. The punch-to-set tool also forms a plug within the bottom sub flow bore 505 such that surface pressure can be applied through the production tubing 10 since the plug isolates the fluid within the production tubing 10 from the perforated production liner 40 below. Pressuring up on the production tubing 10 also pressures up the packer mandrel flow bore 205 and allows fluid to flow into the recess 530. The pressure differential between the fluid in the recess 530 and the fluid in the well bore 20 exerts an upward force against the hydraulic piston 520. When the upward force is sufficient to overcome the shear screws 524 between the hydraulic piston 520 and the bottom sub 510, the shear screw 524 will shear and the hydraulic piston 520 starts to move upwardly to begin the setting process.

As the hydraulic piston 520 moves upwardly, the lower lock ring housing 540 connected thereto via threads 542 and set screws 522 will also move upwardly. As the lower lock ring housing 540 moves upwardly, the lower slip 490 and the lower lock ring 550 will also move upwardly. This upward force drives the lower slip 490 up and over the lower wedge 480 to engage the casing 25. Continued movement shears the shear pin 482 in the lower wedge 480 and allows further compression of the resilient sealing elements 440, 450, 460 to form a seal against the casing 25. Referring now to FIGS. 2B and 2C, the resilient sealing elements 440, 450, 460 compress, the shear pin 422 in the upper wedge 420 shears and the upper wedge 420 is driven under the upper slip 410 to drive it outwardly into engagement with the casing 25. The upper slip 410 is forced outwardly against the casing 25 because it engages the upper lock ring housing 340, which forms a connection with the packer mandrel 210 that prevents upward movement. In particular, the upper lock ring housing 340 is prevented from moving upwardly by the upper lock ring 350 interacting with the packer mandrel 210, which allows movement of the upper lock ring housing 340 only in the downward direction.

When the packer assembly 400 is set, the upper element shoe 430 and the upper element backup shoe 435 as well as the lower element shoe 470 and the lower element backup shoe 475 work together to mechanically maintain the squeeze force on the resilient sealing elements 440, 450, 460 and create an element extrusion barrier when the packer assembly 400 is fully set. In addition, the lower lock ring 550 engages the profile 235 of the packer mandrel 210 to lock the packer assembly 400 in the set position via the lower lock ring housing 540. In particular, as the lower lock ring 550 is forced up, the upwardly facing teeth 554 of the lower lock ring 550 slide up and over the corresponding saw-tooth profile 235 on the packer mandrel 210 during the packer assembly 400 setting process. The interaction between the upwardly facing teeth 554 of the lower lock ring 550 and the saw-tooth profile 235 on the packer mandrel 210 prevents any downward movement of the lower lock ring 550 and lower lock ring housing 540. Therefore, the lower lock ring 550 holds the lower lock ring housing 540 in the set position to continue exerting a force on the packer assembly 400 components to squeeze the resilient sealing elements 440, 450, 460 into engagement with the surrounding casing 25. Once the packer assembly 400 is set, the tubing plug provided by the punch-to-set tool must be removed, such as by retrieval to the surface, to resume normal operations.

Figure 3:
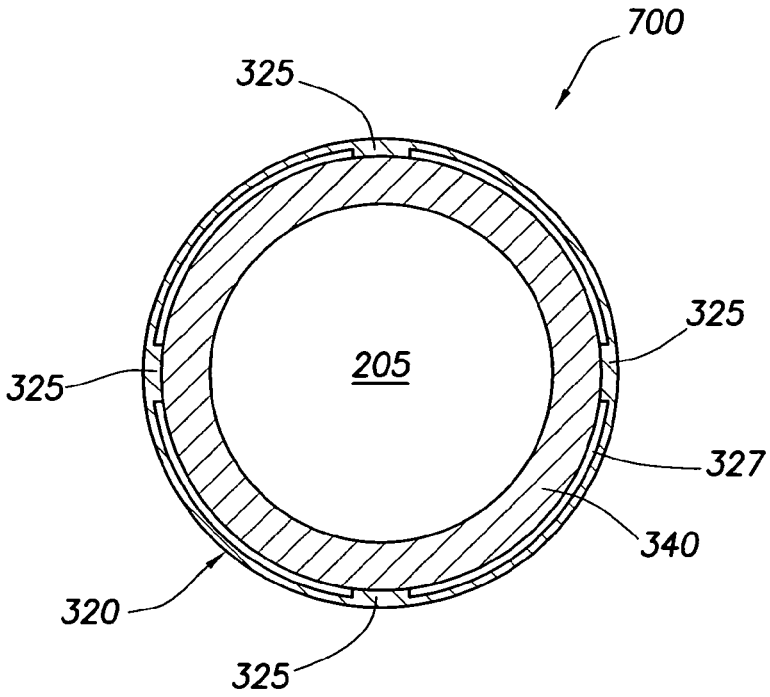
FIG. 3 provides an enlarged cross-sectional end view, taken along Section 3-3 of FIG. 2B, of one embodiment of an anti-rotation clutch.

Referring now to FIGS. 2B and 3, it may be desirable to remove the packer system 200 from the well bore 20, such as by milling. To perform a milling removal operation, the production tubing 10 is disconnected from the packer system 200 and removed from the well bore 20. Then a milling tool is run down onto the packer system 200 to begin milling away the packer system 200. The milling tool mills the packer system 200 components downwardly until it mills away at least a portion of the upper slip 410 and/or the upper wedge 420 to loosen the packer system 200 for removal. However, the hydrostatic piston 320 is not connected or threaded to any other component in the non-actuated configuration shown in FIG. 2B, and therefore, the hydrostatic piston 320 is likely to catch on the mill and rotate with it instead of being milled away. Therefore, an anti-rotation clutch 700 is provided for interconnecting the hydrostatic piston 320 with the upper lock ring housing 340 in the actuated position. In particular, as best shown in FIG. 3, the lowermost end of the hydrostatic piston 320 comprises a series of dogs 325 separated by gaps 327, and the dogs 325 are designed to matingly engage corresponding grooves 345 formed within the uppermost end of the upper lock ring housing 340, as best shown in FIG. 2B. When the hydrostatic piston 320 interconnects with the upper lock ring housing 340 via the anti-rotation clutch 700, then milling operations can be completed down to the upper slip 410 and/or upper wedge 420.

Figure 4A:
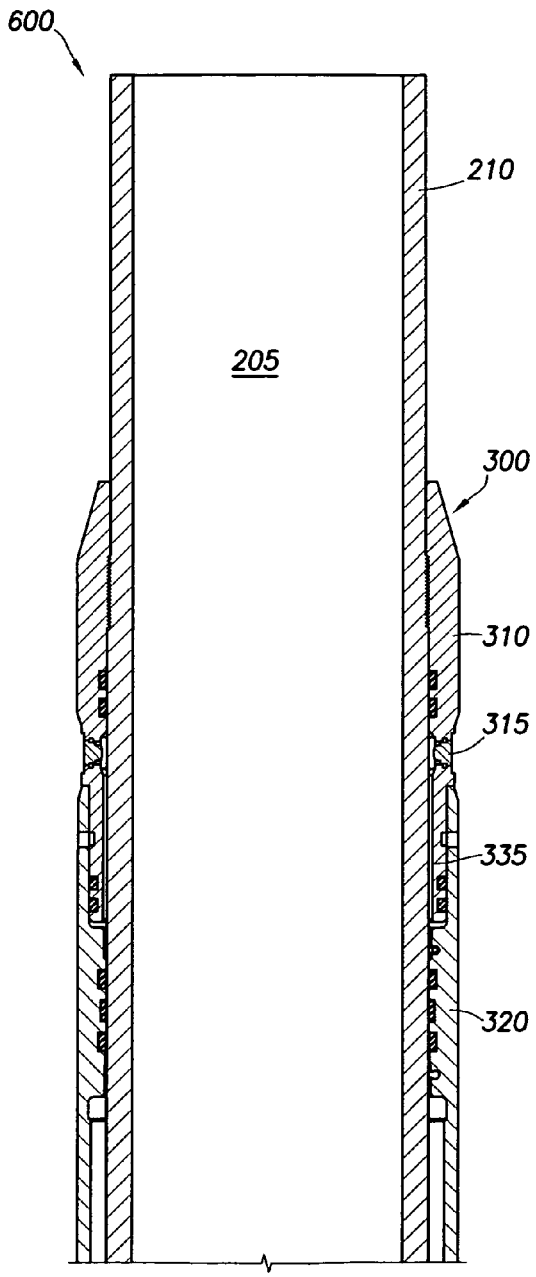
FIGS. 4A through 4C, when viewed sequentially from end-to-end, provide a cross-sectional side view of another embodiment of a packer system comprising an interventionless, hydrostatically-actuated, top-down actuating or setting module connected to a packer assembly.
Figure 4B:
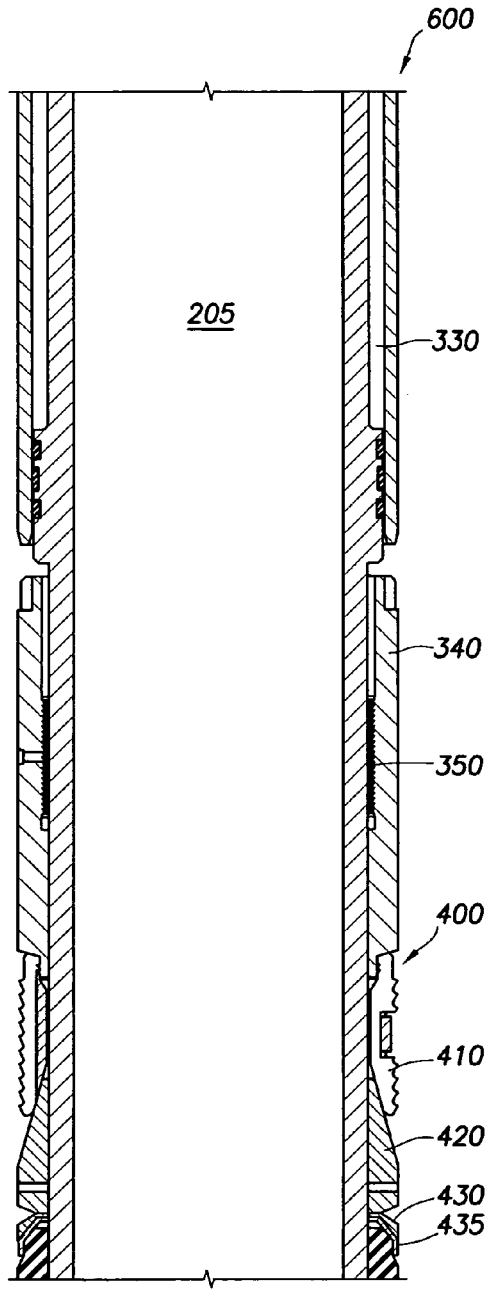
Figure 4C:
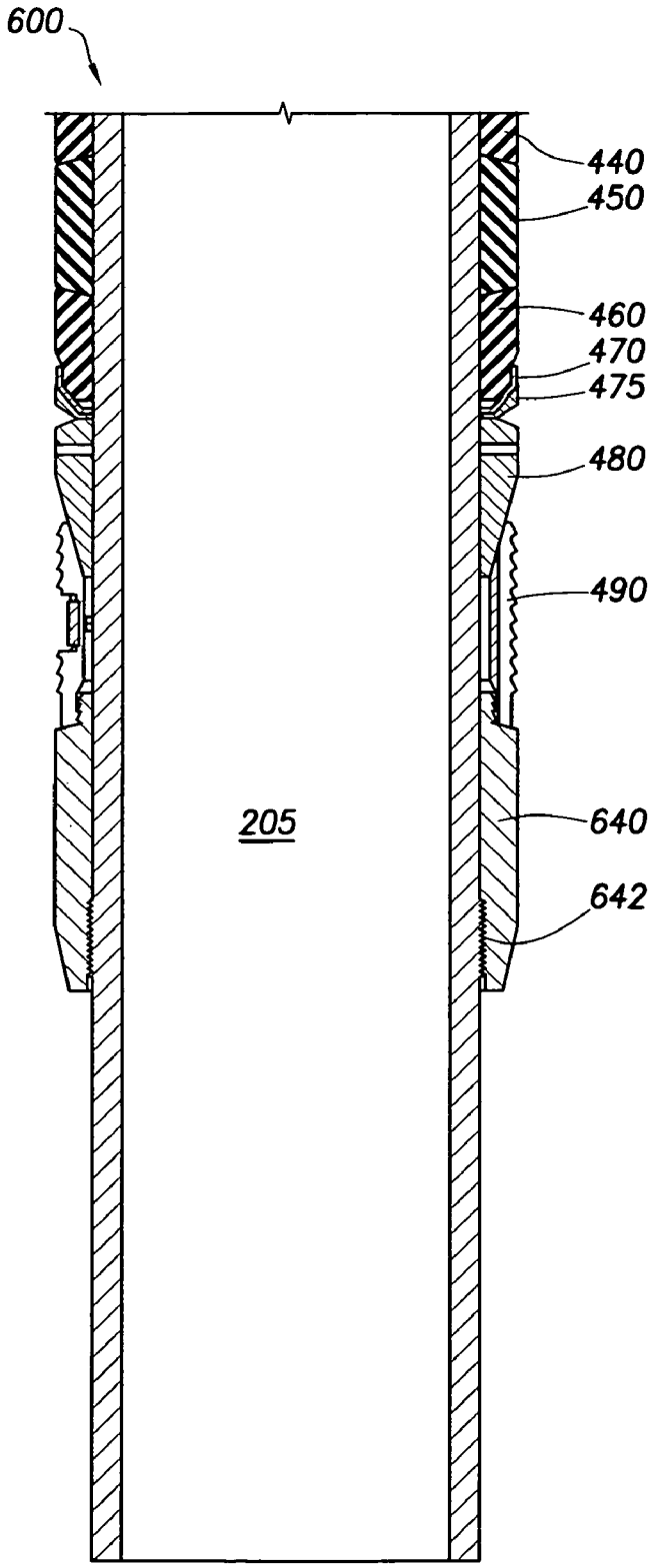

Referring now to FIGS. 4A through 4C, a second embodiment of a packer system 600 is depicted comprising many of the same features as the packer system 200 of FIGS. 2A through 2D, with like components having like reference numerals. The packer system 600 of FIGS. 4A through 4C is a less complex version of the packer system 200 of FIGS. 2A through 2D in that it includes the interventionless, hydrostatically-actuated, top-down setting module 300 and the packer assembly 400, but eliminates the contingency hydraulic setting module 500 that requires surface intervention. As shown in FIG. 4C, the bottom sub 510 and the lower lock ring housing 540 are also eliminated, and a fixed housing component 640 that connects via threads 642 to the exterior of the packer mandrel 210 is provided below the lower slip 490. The operation of the hydrostatically-actuated, top-down setting module 300 to set the packer assembly 400 is identical to that described above with respect to the packer system 200 of FIGS. 2A through 2D. However, the lower slip 490 is prevented from downward movement by the fixed housing component 640 rather than the lower lock ring housing 540.

Setting a downhole tool, such as a packer assembly 400, in one trip into the well bore 20 using an interventionless, hydrostatically-actuated, top-down setting module 300 as described above is more cost effective and less time consuming than setting a downhole tool using conventional hydraulic methods that require making one or more trips into the well bore 20 to insert and remove a tubing plug. The top-down setting module 300 will also provide sufficient actuating force to completely set a packer assembly 400, even when hydrostatic pressure can only be supplied to the well bore 20 and not the production tubing 10, and the actuating force is not diminished during the setting process. The foregoing descriptions of specific embodiments of the packer systems 200, 600 and the methods for setting packer assemblies 400 within a well bore 20 have been presented for purposes of illustration and description and are not intended to be exhaustive or to limit the invention to the precise forms disclosed. Obviously many other modifications and variations are possible. In particular, the specific type of downhole tool, or the particular components that make up the downhole tool could be varied. For example, instead of a packer assembly 400, the downhole tool could comprise an anchor or another type of plug. Further, the downhole tool may be a permanent tool, a recoverable tool, or a disposable tool, and other removal methods besides milling the downhole tool may be employed. For example, one or more components of the downhole tool may be formed of materials that are consumable when exposed to heat and an oxygen source, or materials that degrade when exposed to a particular chemical solution, or biodegradable materials that degrade over time due to exposure to well bore fluids. In other embodiments, the downhole tool may include frangible components allowing for tool removal by explosive charge. Many other removal methods are possible.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What we claim as our invention is:

1. An apparatus for actuating a downhole tool within a well bore comprising:

a cylindrical mandrel extending longitudinally through the downhole tool;

an interventionless, hydrostatic, top-down actuating piston disposed about the mandrel and forming a first chamber and a second chamber therebetween; and a rupture disk that prevents fluid communication between the well bore and the first chamber until sufficient hydrostatic pressure is applied to the well bore to fail the rupture disk;

wherein the piston actuates the downhole tool through a mechanical connection between the piston and the downhole tool.

2. The apparatus of claim 1 further comprising an upper locking mechanism for locking the downhole tool in an actuated position after the top-down actuating piston is hydrostatically actuated to actuate the downhole tool into the actuated position.

3. The apparatus of claim 2 further comprising an anti-rotation clutch forming a connection between the top-down actuating piston and the upper locking mechanism when the top-down actuating piston is hydrostatically actuated.

4. The apparatus of claim 1 further comprising:

a hydraulic, bottom-up contingency actuating piston disposed about the mandrel.

5. The apparatus of claim 4 further comprising a port generated through a wall of the mandrel to hydraulically-actuate the bottom-up contingency actuating piston.

6. The apparatus of claim 4 further comprising a lower locking mechanism for locking the downhole tool in an actuated position after the bottom-up contingency actuating piston is hydraulically actuated to actuate the downhole tool into the actuated position.

7. A method of actuating a downhole tool within a well bore comprising:

connecting a top-down actuating module to the downhole tool;

running the downhole tool to a desired depth within the well bore;

pressuring up the well bore without pressuring up an internal flow bore extending through the top-down actuating module;

hydrostatically actuating an upper piston of the top-down actuating module to generate and exert an actuation force onto the downhole tool through a mechanical connection between the upper piston and the downhole tool; and actuating the downhole tool into an actuated position, thereby at least partially sealing an upper annular portion of the well bore from a lower annular portion of the well bore.

8. The method of claim 7 further comprising:

maintaining the actuation force on the downhole tool after actuating the downhole tool.

9. The method of claim 7 wherein hydrostatically actuating the upper piston comprises:

opening a pathway into a first chamber of the top-down actuating module;

filling the first chamber with a fluid from the well bore; and exerting an actuating force on the piston due to the pressure differential between the first chamber and a second chamber.

10. The method of claim 7 further comprising locking the downhole tool in the actuated position.

11. The method of claim 7 further comprising:

connecting a hydraulic, bottom-up contingency actuating module to the downhole tool before running the downhole tool to the desired depth within the well bore.

12. The method of claim 11 wherein, if the upper piston fails to exert an actuation force onto the downhole tool, the method further comprises:

inserting a plug into a throughbore of the bottom-up contingency actuating module;

pressuring up the throughbore;

hydraulically actuating a lower piston of the bottom-up contingency actuating module to exert an actuation force onto the downhole tool; and actuating the downhole tool into an actuated position.

13. The method of claim 12 further comprising generating a port through a wall surrounding the throughbore to hydraulically actuate the lower piston.

14. An apparatus for actuating a downhole tool within a well bore comprising:

an interventionless, hydrostatic, top-down actuating module connected above the downhole tool and having a fluid flow bore extending longitudinally therethrough, the fluid flow bore being at least partially defined by an innermost solid wall that presents no potential fluid leak path between the fluid flow bore and the well bore above the downhole tool;

wherein, in response to an increase in pressure applied to a movable piston of the apparatus, the piston actuates the downhole tool through a mechanical connection between the piston and the downhole tool; and wherein the innermost solid wall extends within the piston and substantially along an entire longitudinal length of the piston.

15. The apparatus of claim 14 further comprising:

a hydraulic, bottom-up contingency actuating module connected below the downhole tool and having a throughbore extending longitudinally therethrough in fluid communication with the fluid flow bore.

16. The apparatus of claim 15 further comprising:

a solid wall surrounding the throughbore that presents no potential leak path between the throughbore and the well bore below the downhole tool; and a port selectively generated through the solid wall to actuate the bottom-up contingency actuating module.

17. An interventionless, hydrostatic, top-down actuating apparatus for a downhole tool within a well bore wherein a piston of the apparatus forms at least a portion of an exterior of the apparatus and the piston actuates the downhole tool through a mechanical connection between the piston and the downhole tool;

wherein the apparatus comprises a central flow bore that extends within the piston and along substantially an entire longitudinal length of the piston;

wherein the piston is substantially sealed from exposure to the flow bore; and wherein the piston is actuated in response to an increased exposure of the piston to a fluid of the well bore.

18. A downhole tool comprising the actuating apparatus of claim 17.

19. The actuating apparatus of claim 17 comprising no fluid communication pathway between a fluid flow bore extending through the actuating apparatus and the well bore surrounding the actuating apparatus.

20. The actuating apparatus of claim 19 wherein the fluid flow bore is surrounded by a solid wall that prevents fluid communication between the fluid flow bore and the well bore.

21. An apparatus for actuating a downhole tool within a well bore, comprising:

a cylindrical mandrel extending longitudinally through the downhole tool;

an interventionless, hydrostatic, top-down actuating piston disposed about the mandrel and forming a first chamber and a second chamber therebetween;

a rupture disk that prevents fluid communication between the well bore and the first chamber until sufficient hydrostatic pressure is applied to the well bore to fail the rupture disk;

an upper locking mechanism for locking the downhole tool in an actuated position after the top-down actuating piston is hydrostatically actuated to actuate the downhole tool into the actuated position; and an anti-rotation clutch forming a connection between the top-down actuating piston and the upper locking mechanism when the top-down actuating piston is hydrostatically actuated.

* * * * *